US006438907B1

(12) United States Patent
McCarthy

(10) Patent No.: US 6,438,907 B1
(45) Date of Patent: Aug. 27, 2002

(54) ENTRANCEWAY AND DISASTER SHELTER UTILIZING THE SAME

(76) Inventor: Walton W. McCarthy, Radius Defense, Inc., 222 Blakes Hill Rd., Northwood, NH (US) 03261

( * ) Notice: Subject to any disclaimer, the term of this patent is extended or adjusted under 35 U.S.C. 154(b) by 0 days.

(21) Appl. No.: 09/330,870

(22) Filed: Jun. 11, 1999

(51) Int. Cl.[7] ..... E04H 9/00
(52) U.S. Cl. ..... 52/169.6; 52/169.1; 52/19
(58) Field of Search ..... 52/19, 20, 169.1, 52/169.6

(56) References Cited

U.S. PATENT DOCUMENTS

| | | | | | |
|---|---|---|---|---|---|
| 2,888,870 | A | * | 6/1959 | Drager | 454/338 |
| 2,968,130 | A | * | 1/1961 | Bascom | 52/169.6 X |
| 3,138,124 | A | * | 6/1964 | Baier | 52/169.6 X |
| 3,934,066 | A | * | 1/1976 | Murch | 442/221 |
| 4,660,334 | A | * | 4/1987 | McCarthy | 52/169.6 |
| 5,017,039 | A | * | 5/1991 | Spiess et al. | 52/19 X |
| 5,115,613 | A | * | 5/1992 | McCarthy | 52/169.6 |
| 5,201,151 | A | * | 4/1993 | LeBlanc et al. | 52/20 |
| 5,600,923 | A | * | 2/1997 | Riley | 52/79.9 |

* cited by examiner

*Primary Examiner*—Carl D. Friedman
*Assistant Examiner*—Brian E. Glessner
(74) *Attorney, Agent, or Firm*—Michael J. Persson; Lawson, Philpot & Persson, P.C.

(57) ABSTRACT

An entranceway for a disaster shelter and a disaster shelter. The entranceway include a substantially hollow main manway, a hatch dome ring disposed about, and extending outward from, the open top of the main manway; and a hatch dome cover removably attached to the hatch dome ring such that the hatch dome cover forms a weather resistant seal with the hatch dome ring. The exterior surfaces of the preferred hatch dome ring and hatch dome cover are manufactured of an intumescent laminate material. A substantially hollow emergency escape manway is disposed through the main manway wall to allow an alternate point of egress from the shelter in the event that the hatch dome cover is blocked by debris. The preferred entranceway also includes an air filter and a septic tank, each located exterior to the manway such that each may be accessed by a shelterist within the manway. The disaster shelter includes an entranceway, a substantially hollow shelter cell, and a seismic joint joining the entranceway and the shelter cell. The seismic joint is dimensioned to allow the entranceway to move relative to the shelter cell and to maintain a watertight relationship between the entranceway and the shelter cell.

19 Claims, 6 Drawing Sheets

ENTRANCEWAY AND DISASTER SHELTER UTILIZING THE SAME

FIELD OF THE INVENTION

The present invention relates to the field of disaster shelters and, in particular, to an entranceway for a disaster shelter that enhances the protection of its occupants in the event of a disaster.

BACKGROUND OF THE INVENTION

In spite of a large amount of misinformation which has been presented to the public, there is convincing scientific and technical information available that it is possible for most people to survive a fall scale exchange of nuclear weapons, provided that proper advance preparations are made.

It is acknowledged that there would be little incentive for an individual to survive such a nuclear holocaust if, as a result, all life on earth were doomed to extinction or marginal existence. However, the National Academy of Sciences (NAS) has produced extensive reports on the atmospheric effects from various war scenarios, which contradict any such idea. In reality, therefore, the question today is not whether persons can survive a nuclear holocaust, but whether people have the will and determination to prepare for survival.

Some efforts have been made to prepare shelters capable of providing some degree of protection in the event of a nuclear blast or multiple detonations. Most such shelters were designed to afford a measure of protection from fallout. However, these fallout shelters provide no blast protection, nor do they protect against any number of certain other surface effects, such as a burst of nuclear radiation, the fireball which can reach millions of degrees Fahrenheit, thermal radiation transmitted from the fireball, fire storms produced by the thermal radiation, pressure waves (both under and over pressure), and blast wind.

A number of underground disaster shelters have been developed to overcome the problems attendant to traditional fallout shelters. The typical backyard, or personal, shelter has the capability of providing shelter for a small number of people, such as a family unit and incorporates features to protect its occupants against some of the effects of nuclear weapons. However, as these shelters must allow air to be taken in and vented, and must permit access to the shelter, it is possible for intruders to flush out the occupants with the use of gasoline, water, fire, etc. In addition, many current shelters do not protect against the use of a vehicle to force open the hatch.

In my U.S. Pat. No. 4,660,334 issued on Apr. 28, 1987, incorporated herein by reference, I describe a shelter capable of producing survival for its occupants during and after one or more nuclear blasts. Such a shelter is capable of withstanding large doses of neutron and gamma radiation, ground shock, and substantial over pressures, as well as a variety of other conditions, both short and long term, enumerated in my patent.

In my U.S. Pat. No. 5,115,613 issued on May 26, 1992, also incorporated herein by reference, I describe an improved shelter having an enhanced ability to resist the blast effect resulting from the detonation of a nuclear device. The shape of this shelter was rendered more compact and less expensive to manufacture and install than that of the shelter described in my U.S. Pat. No. 4,660,334 and the construction of the connecting shaft below the command station was improved such that the system better absorbed the downward forces on the command station.

Each of my patented shelters is effective at resisting a blast effect from the detonation of a nuclear or other explosive device, and allowing its occupants to survive such a blast. In addition, each may be sealed to prevent intruders from flushing out the occupants with gasoline, water, fire, etc., and each protects against the use of a vehicle to force open the hatch. However, neither of these shelters fully protects shelterists from assault by intruders. For example, neither employ an entranceway that has a low profile and may be easily concealed. Neither provides an entranceway that is fully fire resistant, such that an intruder utilizing a flamethrower would be deterred, or that provides the shelterists with an alternative means of egress in the event that an intruder covers the entranceway with a heavy object, such as a tree or large rock. Neither provides a quick acting hatch or integral locking bar to allow shelterists to quickly enter, close, and secure the hatch in the event that an intruder is observed. Finally, neither entranceway allows the air filtration and septic systems to be accessed from within the shelter.

Therefore, there is a need for a disaster shelter for protecting shelterists during disasters such as tornadoes, storms, forest fires, power failures, nuclear power plant accidents, nuclear terrorism, and a full scale protracted nuclear, chemical, and biological war, that includes an entranceway that is impervious to intruders. In particular, there is need for an entranceway for a disaster shelter that has a low profile and may be easily concealed, is fully fire resistant, provides the shelterists with an alternative means of egress in the event that an intruder covers the entranceway with a heavy object, provides a quick acting hatch or integral locking bar to allow shelterists to quickly enter, close, and secure the hatch in the event that an intruder is observed, and allows the air filtration and septic systems to be accessed from within the shelter.

SUMMARY OF THE INVENTION

The present invention is an entranceway for a disaster shelter and a disaster shelter that overcomes the drawbacks of the prior art. All embodiments of the entranceway include a substantially hollow main manway, a hatch dome ring disposed about, and extending outward from, the open top of the main manway; and a hatch dome cover removably attached to the hatch dome ring such that the hatch dome cover forms a weather resistant seal with the hatch dome ring.

In the preferred embodiment of the entranceway, the exterior surfaces of the hatch dome ring and hatch dome cover are manufactured of an intumescent laminate material. The preferred dome cover is attached to the hatch dome ring via a hinge and is secured to dome ring via an integral locking bar such that a substantially dome shaped surface having an angle of incidence of less than twenty degrees is formed. In this preferred embodiment, a substantially hollow emergency escape manway is disposed through the main manway wall to allow an alternate point of egress from the shelter in the event that the hatch dome cover is blocked by debris. An air inlet is preferably disposed through the main manway wall, and at least one vent opening is disposed through the hatch ring relative to the air inlet and dimensioned such that air is allowed to enter the air inlet and rain is prevented from entering the air inlet. The preferred entranceway also includes a HEPA air filter and a septic tank, disposed within an air filter compartment and septic compartment respectively. These compartments are preferably located exterior to the manway such that each may be accessed by a shelterist within the manway.

The disaster shelter includes an entranceway, a substantially hollow shelter cell, and a seismic joint joining the entranceway and the shelter cell. The seismic joint is dimensioned to allow the entranceway to move relative to the shelter cell and to maintain a watertight relationship between the entranceway and the shelter cell. The entranceway may be any variation of those described above, but will always include a substantially hollow main manway, a hatch dome ring disposed about, and extending outward from, the open top of the main manway; and a hatch dome cover removably attached to the hatch dome cover such that the hatch dome cover forms a weather resistant seal with the hatch dome ring.

Therefore, it is an aspect of the invention to provide a disaster shelter that is capable of resisting a blast effect from the detonation of a nuclear or other explosive device, and allowing its occupants to survive such a blast.

It is a further aspect of the invention to provide a disaster shelter including an entranceway, which is impervious to intruders.

It is a further aspect of the invention to provide an entranceway for a disaster shelter, which prevents intruders from flushing out the occupants with gasoline, water, fire, etc.

It is a further aspect of the invention to provide an entranceway for a disaster shelter, which protects against the use of a vehicle to force open the hatch.

It is a further aspect of the invention to provide an entranceway for a disaster shelter, which has a low profile and may be easily concealed.

It is a further aspect of the invention to provide an entranceway for a disaster shelter, which is fully fire resistant.

It is a further aspect of the invention to provide an entranceway for a disaster shelter, which provides the shelterists with an alternative means of egress in the event that an intruder covers the entranceway with a heavy object.

It is a further aspect of the invention to provide an entranceway for a disaster shelter, which provides a quick acting hatch or integral locking bar to allow shelterists to quickly enter, close, and secure the hatch in the event that an intruder is observed.

It is a further aspect of the invention to provide an entranceway for a disaster shelter, which does not include exposed bolts that may be removed to provide ingress to intruders.

It is a still further aspect of the invention to provide an entranceway for a disaster shelter, which allows the air filtration and septic systems to be accessed from within the shelter.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
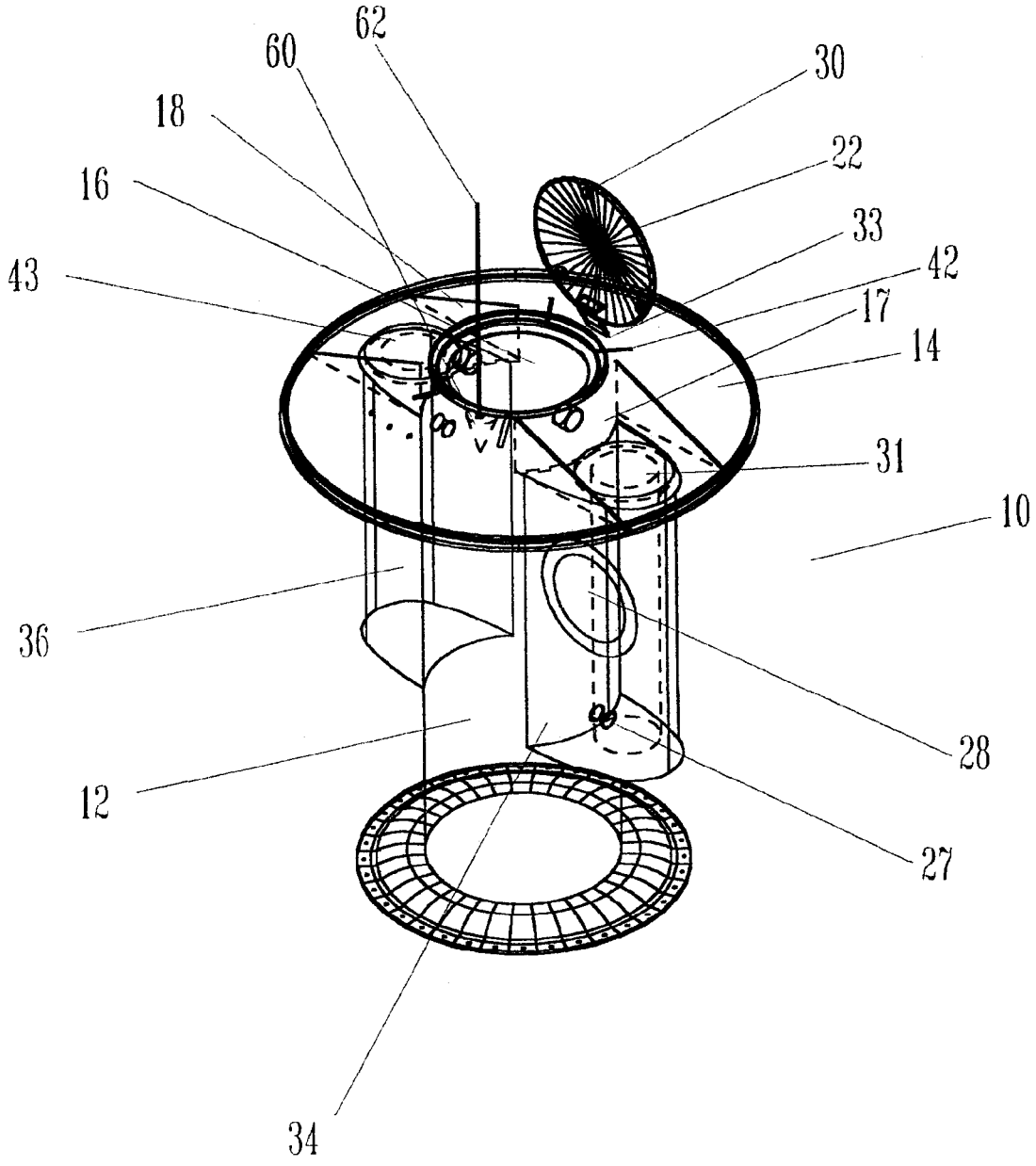
FIG. 1 is an isometric view of the preferred embodiment of the entranceway of the present invention.

Referring first to FIG. 1, one embodiment of the entranceway 10 of the present invention is shown. The entranceway 10 includes a substantially hollow main manway 12. The main manway 12 is preferably manufactured of a fiberglass material and is dimensioned both to allow a large adult to enter and exit the shelter, and to withstand external forces from the earth. Accordingly, the preferred main manway 12 has an interior opening that is 24 inches in diameter and has a wall thickness of 0.5 inches. However, it is understood that a main manway 12 manufactured of different materials, and/or having different dimensions, may be substituted to achieve similar results.

Figure 2:
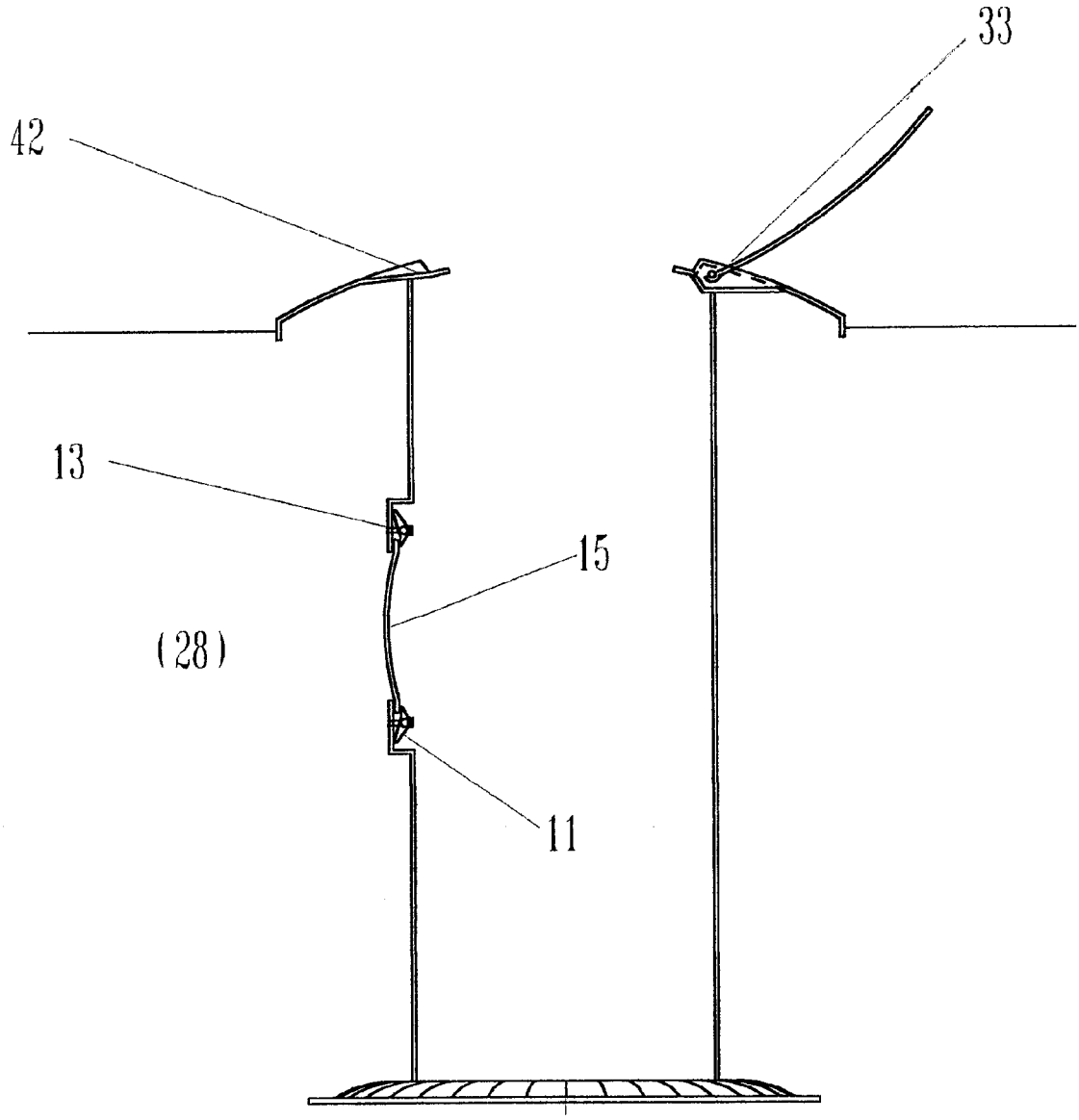
FIG. 2 is a side view of the hatch dome ring, hatch dome cover, main manway and emergency escape manway of the entranceway of the present invention.

A substantially hollow emergency escape manway 28 is preferably disposed through the wall of the main manway 12. This emergency escape manway 28 is dimensioned to provide a shelterist with an alternate point of egress from the shelter 10 in the event that the hatch dome cover 22 is blocked by debris. As shown in greater detail in FIG. 2, the preferred embodiment of the emergency escape manway 28 includes a locking ring 13 and a escape manway cover 15 that is dimensioned to cover the locking ring 13 and lock into place utilizing locking means 11. The escape manway cover 15 opens inwardly within the main manway 12 allowing the backfilled gravel or crushed stone to fill into the main manway 12 when the escape manway cover 15 is opened. In this manner, the escape manway cover 15 provides a shelterist with access to the earth between the escape manway 28 and ground level, while preventing intruders from excavating around the entranceway to gain access to the shelter.

Figure 3:
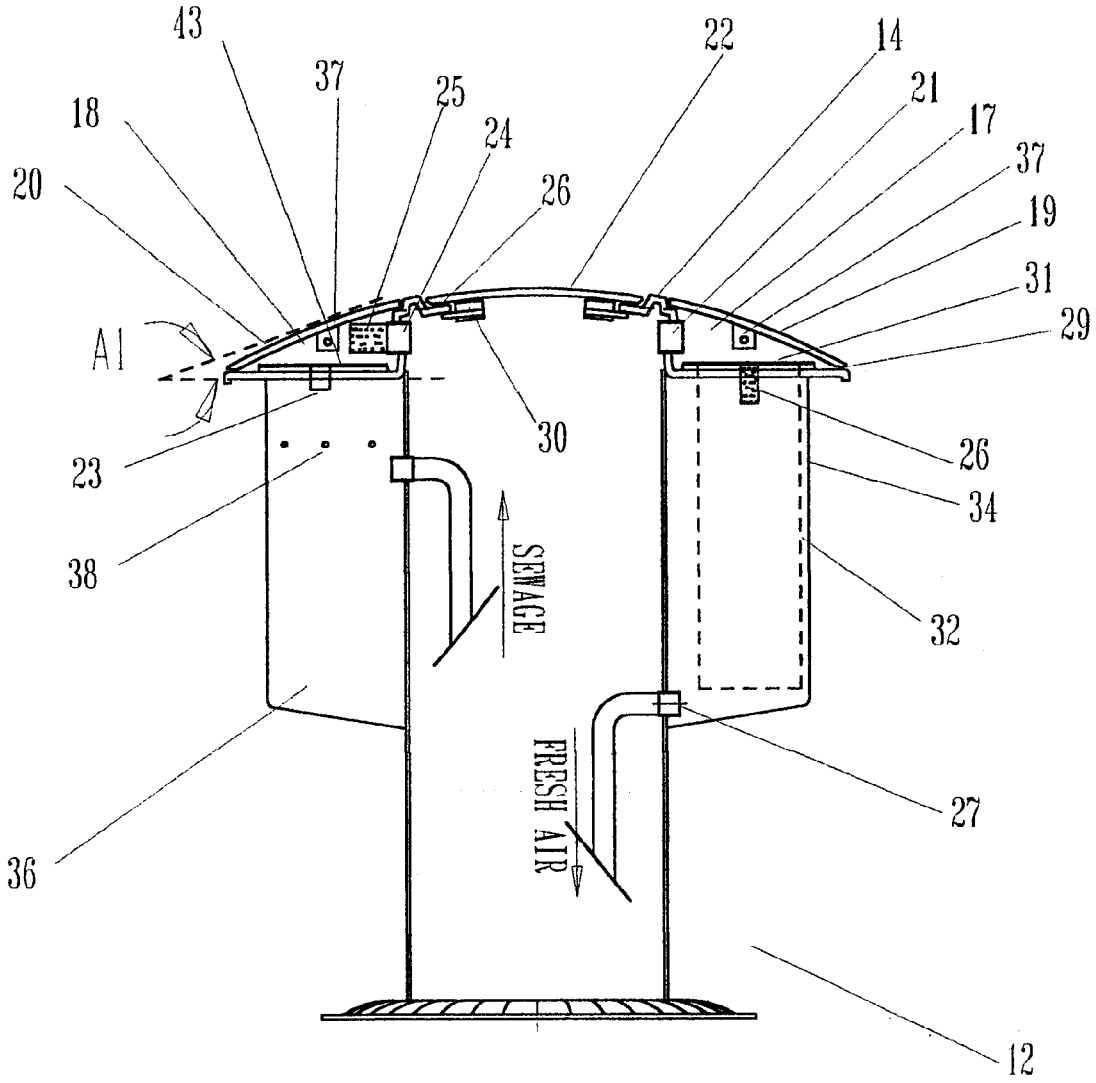
FIG. 3 is a section view of the preferred entranceway of the present invention.

As shown in FIGS. 1 and 3, a hatch dome ring 14 is disposed about, and extends outward from, the open top 16 of the main manway 12. The hatch dome ring 14 is preferably dome shaped and includes a top opening that is bounded by a recessed hatch seal 26 that is dimensioned to receive and form a weather resistant seal with the hatch dome cover 22. This seal 26 is preferably a high temperature silicone gasket capable of withstanding temperatures of four hundred and fifty degrees (450°) Fahrenheit. The hatch dome cover 22 is preferably dome shaped, and is removably attached to the hatch dome ring 14 via a hinge 33. When combined together, the hatch dome ring 14 and hatch dome cover 22 form a substantially dome shaped surface having an angle of incidence A, that is preferably about twenty degrees (20°). A low angle of incidence $A_1$ is preferred in order to prevent damage to the hatch dome 14 and hatch dome cover 22 in the event of high winds caused by storms or nuclear explosion, and to lower the profile of the ring 14 and cover 22, enhancing the concealability of the entranceway.

Hinge 33 may be an internal hinge that is not visible from the exterior of the hatch dome ring 14. However, the preferred hinged 33, is an external hinge that fits within a pocket (not shown) in the hatch dome ring 14. The preferred hatch dome cover 22 is secured to the hatch dome ring 14 via an integral locking bar 30. The combination of the integral hinge 33 and locking bar 30 allows the hatch dome cover 22 to be quickly closed and locked in the event that a shelterist is pursued by an intruder and to resist pressures of negative 5 PSI created by a blast or tornado.

The hatch dome ring 14 includes an air intake manifold pocket 17 covered by an air intake manifold cover 19, and an air exhaust manifold pocket 18 covered by air exhaust manifold cover 20. The air exhaust manifold pocket 18 is disposed over the leaching septic tank vent 23 and is placed under positive pressure by air exhausted from the main manway 12. This air travels through access port/vent 24 and cylinder insect screen 25 and is exhausted through the perimeter gap around the air exhaust manifold cover 20. The access/vent port 24 is normally maintained in open position and allows a shelterist to place their hand into the air exhaust manifold pocket to unlock the mechanism holding the air exhaust manifold cover 20 in place. This feature prevents intruders outside of the shelter from removing the air exhaust manifold cover 20 to sabotage the shelter.

The air intake manifold pocket 17 is disposed on the air intake side, or HEPA filter side, of the main manway 12. Air intake manifold pocket 17 is under negative pressure and supplies air to the shelter through the perimeter of the air intake manifold cover 19. In operation, unfiltered air enters air intake manifold pocket 17 and passes through the HEPA filter intake insect screen 46 into the HEPA filter bag 32 where it is filtered. The filtered air is then sucked though the air intake pipe coupling 27 and piped to the shelter air carbon filter (not shown), where toxins not caught by the HEPA filter bag are neutralized. The resulting filtered air is subsequently fed into the shelter for use by the shelterists. Access port 21 is normally kept closed, but may be opened to allow a shelterist to placed their hand within the air intake manifold pocket 17 to unlock the securing mechanism 37 securing the air exhaust manifold cover 19.

The HEPA filter bag 32 is disposed within the filter compartment 34 that is attached to the exterior of main manway 12. The HEPA filter cover 31 is preferably accessed through air intake manifold cover 19, and removed from the ground surface to allow the HEPA filter bag 32 to be replaced. The preferred HEPA filter bag 32 is made of a material that will filter out 99.9% of particles that are larger than 1 micron. Such a bag design allows heavy particulates, such as sand and grit, to fall to the bottom while allowing air to pass through the vertical walls of the filter bag. The HEPA filter bag 32 also removes and holds radioactive fallout particles, making the HEPA filter bag 32 a source of radiation. Accordingly, it is important that the HEPA filter bag 32 be placed away from shelterists such that there is a mass or earth barrier between the radioactive HEPA filter bag 32 and the shelterists.

Rain is allowed to travel through the perimeter around both air pocket manifolds is 17 and 18 where it exits through perimeter gap 29. Accordingly, the floor of the air intake manifold pocket 17 and air exhaust manifold pocket 18 include raised portions that prevent water from entering the HEPA filter and septic tank.

The leaching septic tank 36 is attached to main manway 12 and contains a plurality of holes 38 to allow the septic fluid to leach out into the ground. The septic tank cover 43 is preferably accessible through the air exhaust manifold cover 20, allowing the septic tank 36 to be manually pumped out from the ground surface.

Figure 4:
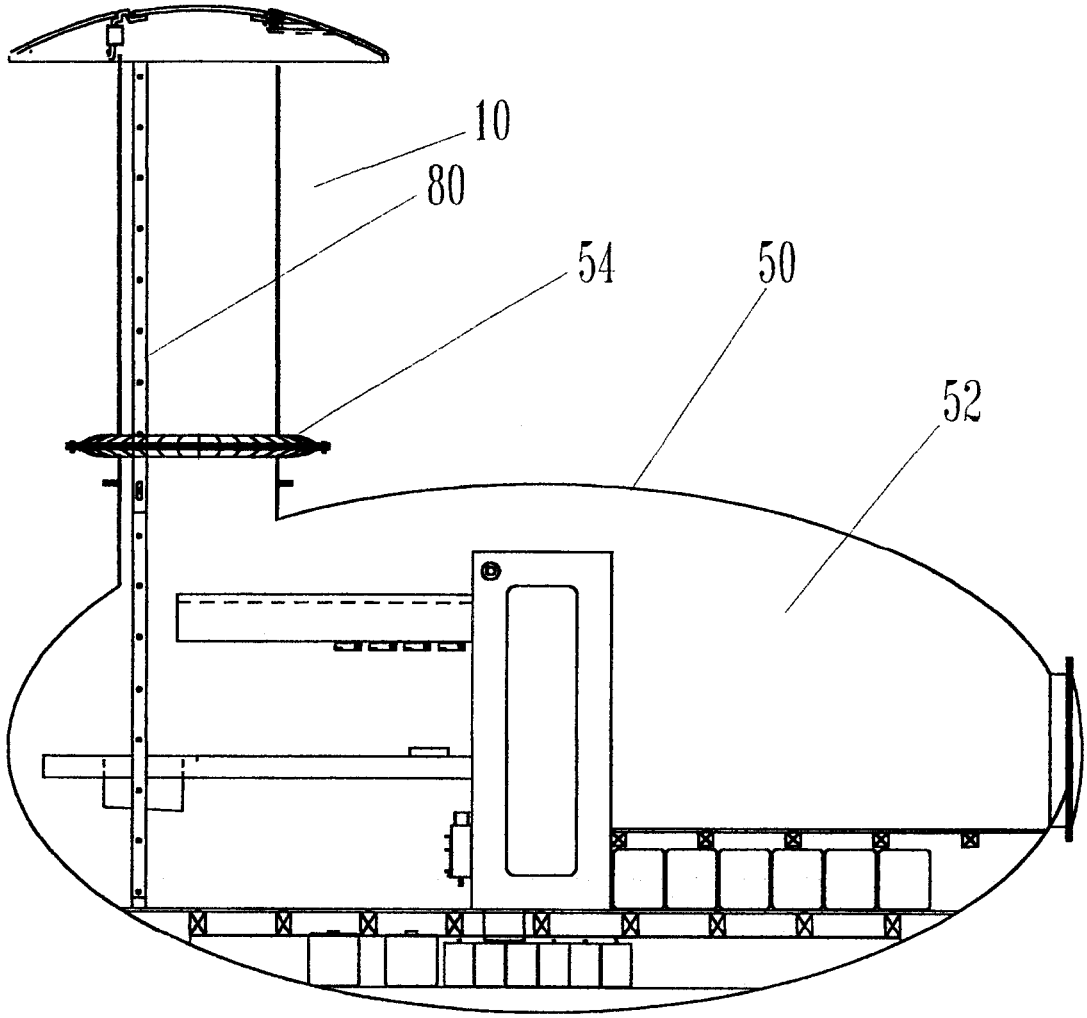
FIG. 4 is an isometric view of the preferred disaster shelter of the present invention.
Figure 5:
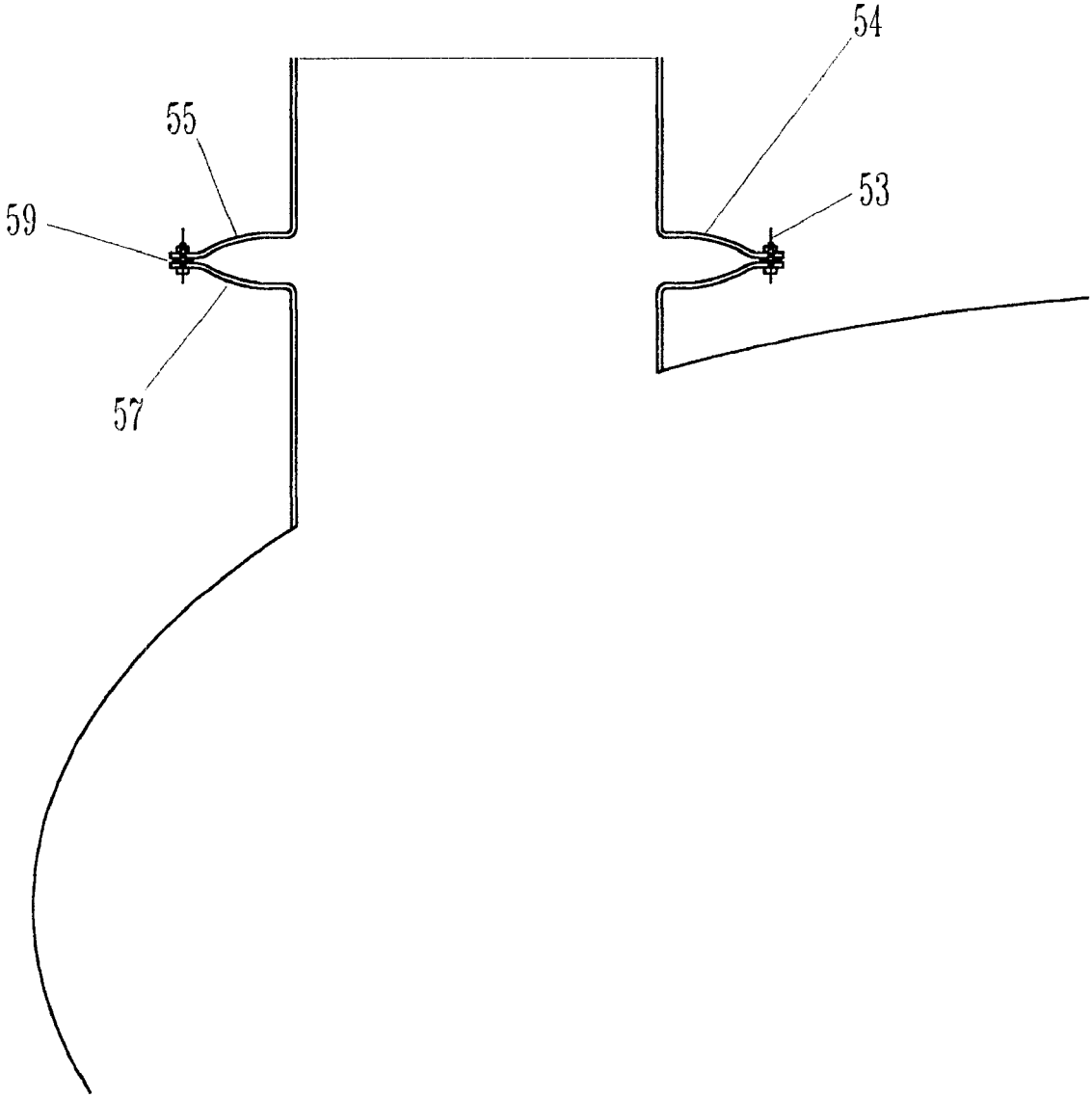
FIG. 5 is a cut away view of the preferred seismic joint utilized to join the entranceway to the shelter cell in the preferred disaster shelter.

Referring now to FIGS. 4 & 5, the preferred disaster shelter 50 of the present invention is shown. The preferred shelter 50 includes an entranceway 10, a substantially hollow parabaloid shelter cell 52, and a seismic joint 54 joining the entranceway 10 and the shelter cell 52. The seismic joint 54 is dimensioned to allow the entranceway 10 to move relative to the shelter cell 52 and to maintain a watertight relationship between the entranceway 10 and the shelter cell 52.

As shown in FIG. 5, the preferred seismic joint 54 is a bellow joint that joins the entranceway 10 to the shelter 50 such that each may move independently from one another. In particular, the seismic joint allows the top of the main manway to tip sideways and allows the entranceway to move up and down, essentially allowing any movement except translation. The preferred seismic joint 54 includes a first fiberglass flange 55 formed integral to the bottom of the main manway 12 of entranceway 10 and a second fiberglass flange 57 formed integral to the top of entranceway portion of the shelter 50. During assembly, the first fiberglass flange 55 and second fiberglass flange 57 are aligned relative to one another, a gasket material 59 is disposed between the flanges 55, 57, and the flanges 55, 57 are mechanically fastened together to form the bellow joint. As shown in FIG. 5, the flanges 55, 57 are attached via a plurality of nuts and bolts. However, it is understood that other mechanical fasteners, such as clips or the like, may also be utilized to achieve similar results.

Because the seismic joint allows the entranceway 10 to move independently from the shelter 50, the ladder 80 that allows shelterists to descend through the main manway 12 into the shelter 50 is made of at least two pieces and includes a slot, which allows the sections to move up and down relative to one another. In the preferred shelter, this ladder 80 is a two piece ladder that is free to move two inches in either direction. However, it is recognized that other ladder designs may serve the same purpose and, therefore, may be substituted to achieve similar results.

Figure 6:
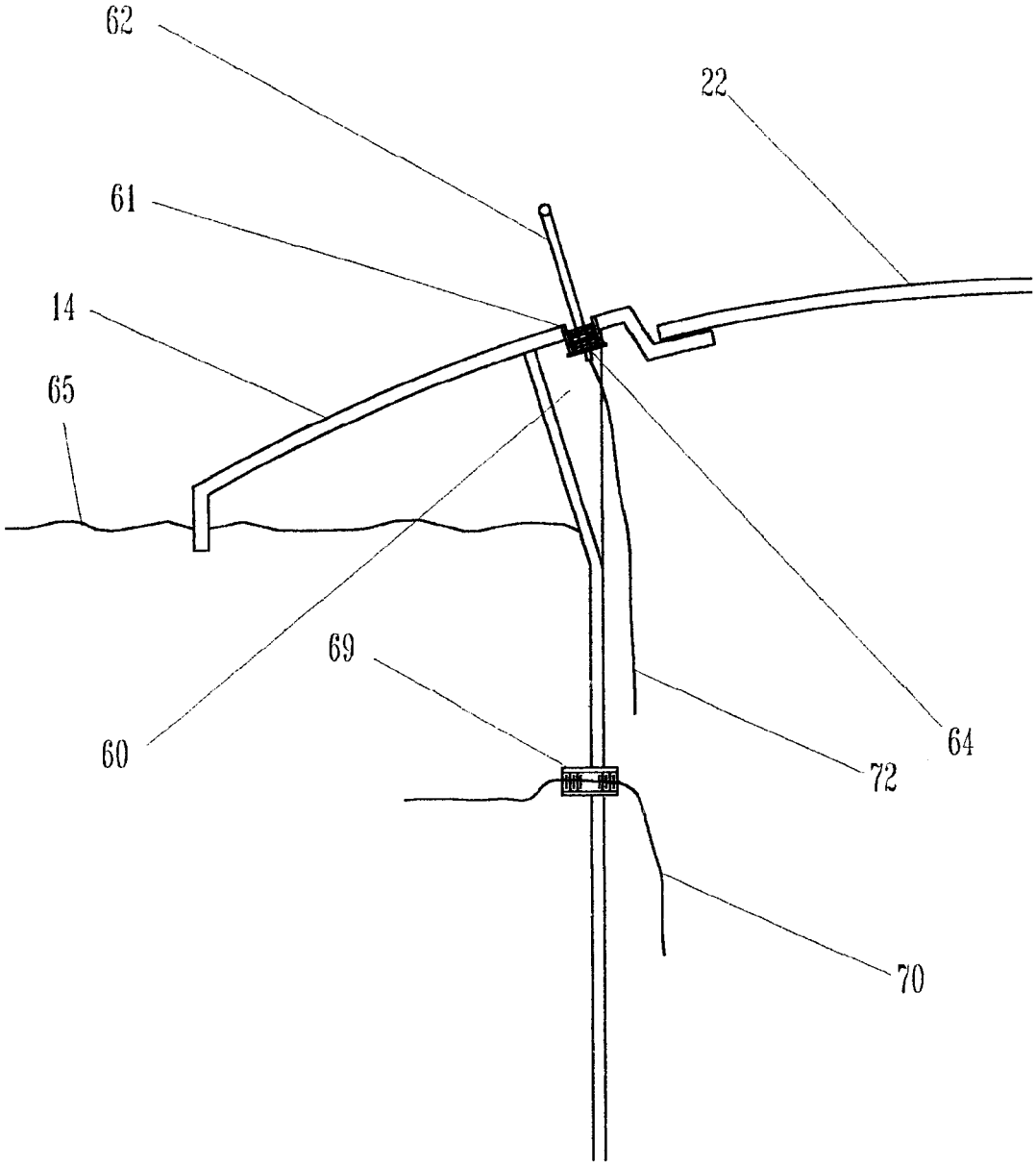
FIG. 6 is a section view of one embodiment of the entranceway showing an antenna cavity disposed through said hatch dome ring and a thru-hull coupling disposed through the main manway.

FIG. 6 shows a section view of one embodiment of the entranceway, which includes an antenna cavity 60 to allow the CB and scanner radio antenna 62 to be installed and removed from inside the entranceway 12. The antenna cavity 60 is preferably a cylindrical tapered cavity, having a diameter of approximately six (6) inches, and extends from the hatch dome 14 to just below the ground 65. The hatch dome at this point contains a threaded coupling 61 that accepts a threaded bushing 64, which holds antenna 62. The antenna cable 72 connects to at least one radio (not shown) disposed within the shelter 50. The preferred antenna cavity 60 allows enough room for a person to hand tighten the bushing 64 into the threaded coupling 61. Although only one antenna pocket 60 is shown, it is recognized that more than one pocket may be utilized in order to accept more than one radio.

Finally, FIG. 6 also shows a thru-hull coupling 69 that allows a watertight passage for various outside services, such as 12 volt power lines, 110 volt power lines, telephone lines, etc., to penetrate the entranceway wall 12 while preventing water from entering the shelter. Typically, one thru-hull coupling is provided for each line, with each located approximately 12 inches below ground level 65.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claim is:

1. An entranceway for a disaster shelter comprising:

a substantially hollow main manway having a main manway wall, a substantially open top and a substantially open bottom:

a substantially hollow emergency escape manway disposed through said main manway wall;

a hatch dome ring disposed about, and extending outward from, said open top of said main manway, said hatch dome ring having an exterior surface; and a hatch dome cover removably attached to said hatch dome ring such that said hatch dome cover forms a weather resistant seal with said hatch dome ring.

2. The entranceway as claimed in claim 1 further comprising an air inlet disposed through said main manway wall, and wherein said hatch dome ring further comprises at least one vent opening, said vent opening being dimensioned and disposed relative to said air inlet such that air is allowed to enter said air inlet and rain is prevented from entering said air inlet.

3. The entranceway as claimed in claim 2 further comprising an air filter disposed between one of said at least one vent openings and said air inlet.

4. The entranceway as claimed in claim 3 wherein said air filter is a highly effective particulate air filter bag.

5. The entranceway as claimed in claim 3 wherein said air filter is disposed within a filter compartment, and wherein said filter compartment is disposed exterior to said main manway wall such that said filter compartment may be accessed from an interior of said main manway.

6. The entranceway as claimed in claim 1 further comprising a septic tank disposed within a septic compartment, and wherein said septic compartment is disposed exterior to said main manway wall such that said septic compartment may be accessed from an interior of said main manway.

7. The entranceway as claimed in claim 1 wherein said hatch dome cover and said hatch dome ring form a substantially dome shaped surface having an angle of incidence of less than twenty degrees.

8. The entranceway as claimed in claim 1 further comprising a cover hinge and wherein said hatch dome cover is removably attached to said hatch dome ring via said cover hinge.

9. The entranceway as claimed in claim 8 wherein said hatch dome cover comprises an integral locking bar for securing said dome cover in locked relation to said dome ring.

10. The entranceway as claimed in claim 1 wherein said hatch dome ring further comprises at least one antenna cavity disposed through said exterior surface.

11. The entranceway as claimed in claim 1 wherein an exterior surface of said hatch dome ring and an exterior surface of said hatch dome cover are manufactured of an intumescent laminate material.

12. A disaster shelter comprising:

an entranceway comprising:

a substantially hollow main manway having a main manway wall, a substantially open top and a substantially open bottom:

a hatch dome ring disposed about, and extending outward from, said open top of said main manway; and a hatch dome cover removably attached to said hatch dome ring such that said hatch dome cover forms a weather resistant seal with said hatch dome ring;

a substantially hollow shelter cell; and a seismic joint joining said entranceway and said shelter cell, said seismic joint being dimensioned to allow said entranceway to move relative to said shelter cell in any manner except translation, and to maintain a watertight relationship between said entranceway and said shelter cell.

13. The disaster shelter as claimed in claim 12 wherein an exterior surface of said hatch dome ring and an exterior surface of said hatch dome cover of said entranceway are manufactured of an intumescent laminate material.

14. The disaster shelter as claimed in claim 12 wherein said entranceway further comprises a substantially hollow emergency escape manway disposed through said main manway wall.

15. The disaster shelter as claimed in claim 12 wherein said entranceway further comprises an air inlet disposed through said main manway wall, and wherein said hatch dome ring of said entranceway further comprises at least one vent opening, said vent opening being dimensioned and disposed relative to said air inlet such that air is allowed to enter said air inlet and rain is prevented from entering said air inlet.

16. The disaster shelter as claimed in claim 12 further comprising an air filter disposed within a filter compartment, and wherein said filter compartment is disposed exterior to said main manway wall such that said filter compartment may be accessed from an interior of said main manway.

17. The disaster shelter as claimed in claim 12 further comprising a septic tank disposed within a septic compartment, and wherein said septic compartment is disposed exterior to said main manway wall such that said septic compartment may be accessed from an interior of said main manway.

18. The disaster shelter as claimed in claim 12 wherein said hatch dome cover and said hatch dome ring form a substantially dome shaped surface having an angle of incidence of less than twenty degrees.

19. The disaster shelter as claimed in claim 12 wherein said hatch dome ring of said entranceway further comprises an antenna cavity disposed through said exterior surface.

* * * * *